US009083091B1

(12) United States Patent
Ravlich

(10) Patent No.: US 9,083,091 B1
(45) Date of Patent: Jul. 14, 2015

(54) ELECTRICAL TERMINAL CONNECTOR FOR SOLDERLESS CONNECTION OF PARTS TO ELECTRICAL CONTACT HOLES

(71) Applicant: Anthony Ravlich, Laguna Hills, CA (US)

(72) Inventor: Anthony Ravlich, Laguna Hills, CA (US)

( * ) Notice: Subject to any disclaimer, the term of this patent is extended or adjusted under 35 U.S.C. 154(b) by 0 days.

(21) Appl. No.: 14/120,587

(22) Filed: Jun. 7, 2014

Related U.S. Application Data

(63) Continuation of application No. 13/987,828, filed on Sep. 6, 2013, now abandoned.

(51) Int. Cl.
*H01R 4/24* (2006.01)

(52) U.S. Cl.
CPC ..... *H01R 4/2416* (2013.01)

(58) Field of Classification Search
CPC .. H01R 12/585; H01R 12/722; H01R 13/111; H01R 13/114; H01R 13/41; H01R 13/6476; H01R 24/64; H01R 43/20; H01R 4/2416; H01R 4/242
USPC ..... 439/733.1, 82, 395–417, 746–873
See application file for complete search history.

(56) References Cited

U.S. PATENT DOCUMENTS

| | | | | |
|---|---|---|---|---|
| 2,329,471 | A * | 9/1943 | King | 439/870 |
| 4,333,700 | A * | 6/1982 | Pugh, III | 439/403 |
| 4,676,579 | A * | 6/1987 | Ting | 439/825 |
| 5,286,218 | A * | 2/1994 | Sakurai et al. | 439/444 |
| D354,268 | S * | 1/1995 | Siemon et al. | D13/133 |
| 6,050,842 | A * | 4/2000 | Ferrill et al. | 439/404 |
| 6,305,950 | B1 * | 10/2001 | Doorhy | 439/76.1 |
| 6,626,694 | B2 * | 9/2003 | Zielke et al. | 439/404 |
| 6,979,222 | B2 * | 12/2005 | Comini | 439/404 |
| 7,044,805 | B1 * | 5/2006 | Huang | 439/676 |
| 7,052,328 | B2 * | 5/2006 | Ciezak et al. | 439/676 |
| 7,344,389 | B2 * | 3/2008 | Kramski | 439/82 |
| 7,708,605 | B2 * | 5/2010 | Shibata et al. | 439/733.1 |
| 7,736,173 | B2 * | 6/2010 | Chen | 439/395 |
| 7,780,483 | B1 * | 8/2010 | Ravlich | 439/751 |
| 8,083,538 | B2 * | 12/2011 | Ofenloch et al. | 439/404 |

OTHER PUBLICATIONS

U.S. Appl. No. 13/987,829, Ravlich.

* cited by examiner

*Primary Examiner* — Briggitte R Hammond
(74) *Attorney, Agent, or Firm* — Dennis W. Beech

(57) ABSTRACT

An electrical terminal connector for attaching electrical parts to printed circuit boards. The terminal connector may have a connecting conductor member with an insulator displacement contact at a first end and a press-fit contact at a second end. The conductor member may have one or more tabs extending outwardly from the longitudinal edges. The tabs may be formed in the shape of a triangle with a first surface sloped at an acute angle to intersect with a second surface extending outwardly approximately orthogonal to the longitudinal edge.

6 Claims, 3 Drawing Sheets

ELECTRICAL TERMINAL CONNECTOR FOR SOLDERLESS CONNECTION OF PARTS TO ELECTRICAL CONTACT HOLES

This application is a continuation-in-part patent application of U.S. patent application Ser. No. 13/987,828, filed Sep. 6, 2013. U.S. patent application Ser. No. 13/987,828 is pending.

BACKGROUND OF THE INVENTION

The invention relates to devices for press-fit insertion or solderless electrical contact in an electrical contact hole of a device or object, for example, a printed circuit board. The new terminal connector device may have a connecting conductor member with an insulator displacement contact at one end and a press fit contact at the opposite end.

Insulator displacement contacts, also known as IDC, for convenience in making connections to insulated wires may be known. Press-fit contacts for insertion through a plated hole of a circuit board to achieve a force fit rather than solder connection may also be known. An example of a press-fit contact for insertion in printed circuit boards that result in good retention force for electrical components and parts and good electrical performance is the Electrical Press-Fit Contact disclosed in U.S. Pat. No. 7,780,483 B1, issued Aug. 24, 2010 that is hereby incorporated by reference. There may also be known contact elements that have a pin contact on one end, and IDC contact at the opposed end, one or more extensions between the contacts, and positioning elements such as guide elements and protruding elements specifically designed for positioning the contact element in a complex module-housing assembly. An example of a compliant terminal disclosed with one end portion as a common open gap IDC and a second end with a press fit insertion connector for mating with a specific structure electrical connector housing may be U.S. Pat. No. 4,676,579. This disclosure uses the IDC end portion not for insulation displacement of a wire or cable conductor, but rather for connection to a conductor by insertion in a connector housing. The housing is structured with protruding elements that engage grooves formed in the opposed sides of the compliant terminal. What is needed is a simple terminal connector that can be insertably fastened in the insulation housing of a part for simple wire attachment at one end and having at an opposite end an insertion pin end for force fit into a through-hole of a printed circuit board.

SUMMARY OF THE INVENTION

The present invention is directed to electrical terminal connectors for attaching electrical parts to printed circuit boards. The terminal connector may have a connecting conductor member with an insulator displacement contact at a first end and a press-fit contact at a second end. The conductor member may have one or more tabs extending outwardly from the longitudinal edges. The tabs may be formed in the shape of a triangle with a first surface sloped at an acute angle to intersect with a second surface extending outwardly approximately orthogonal to the longitudinal edge.

These and other features, aspects and advantages of the present invention will become better understood with reference to the following drawings, description and claims.

DETAILED DESCRIPTION

Figure 1:
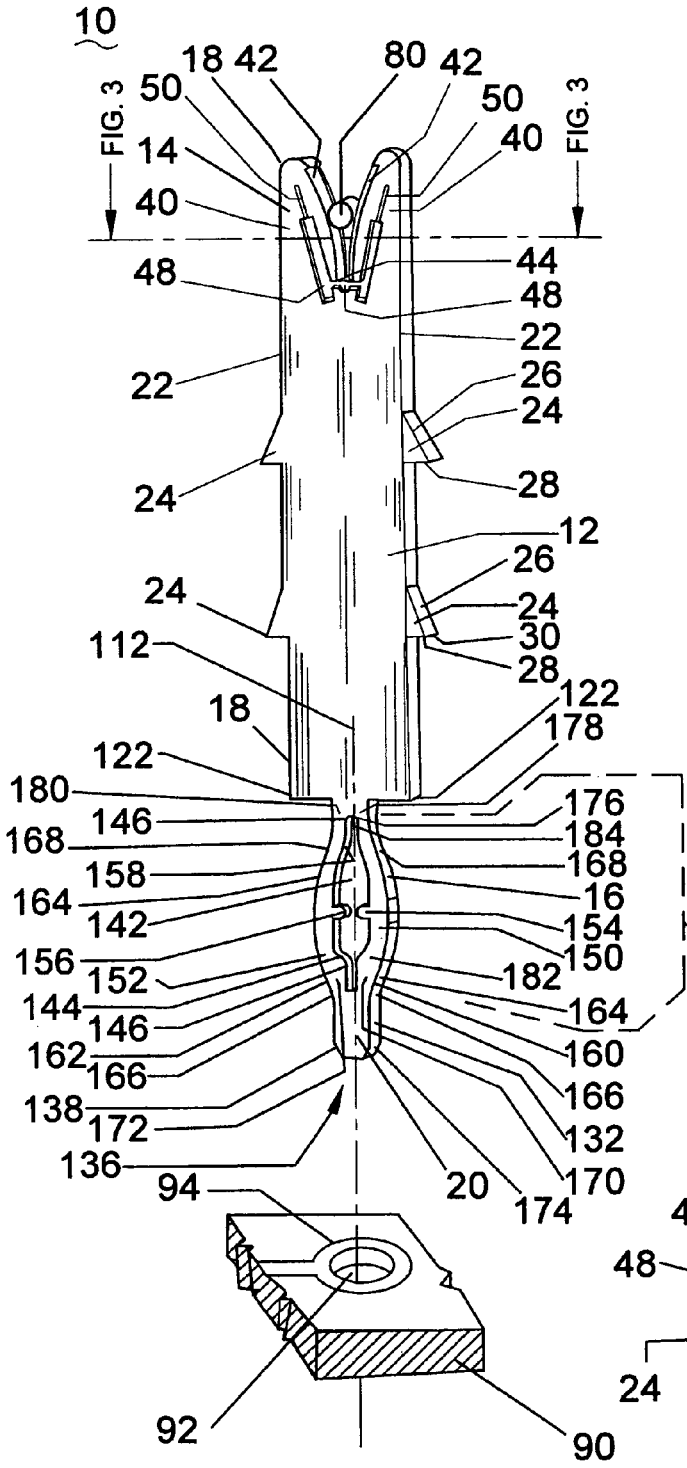
FIG. 1 illustrates a perspective view of an electrical terminal connector with a portion of a circuit board and a wire according to an embodiment of the invention.
Figure 2:
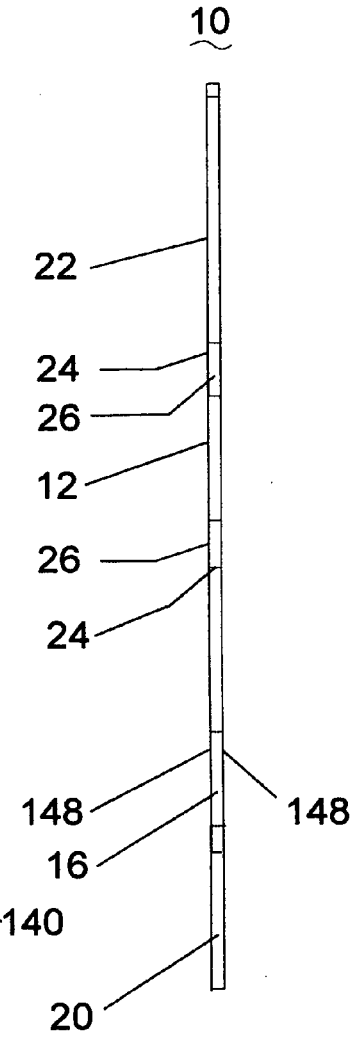
FIG. 2 illustrates a side edge view of an electrical terminal connector according to an embodiment of the invention.
Figure 3:
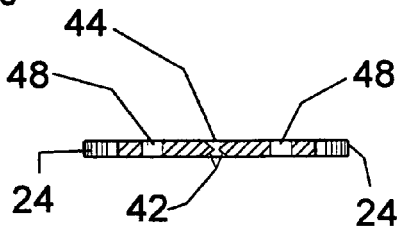
FIG. 3 illustrates a cross-sectional view along lines FIG. 3-FIG. 3 in FIG. 1 according to an embodiment of the invention.
Figure 4:
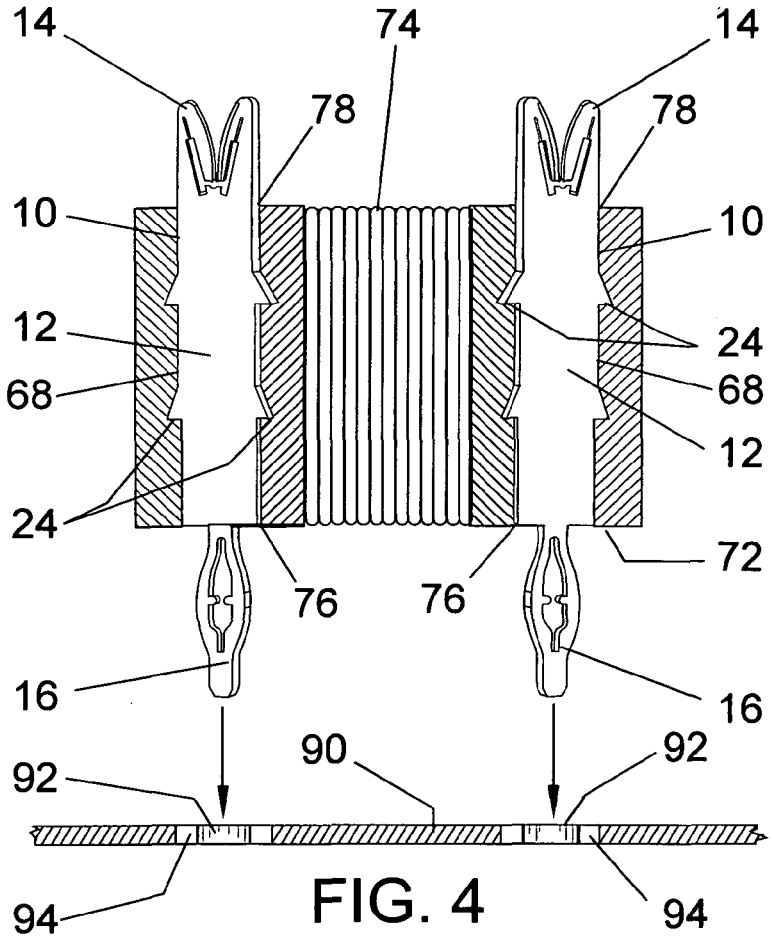
FIG. 4 illustrates a side view of an electrical part with electrical terminal connectors attached to a printed circuit board according to an embodiment of the invention.
Figure 5:
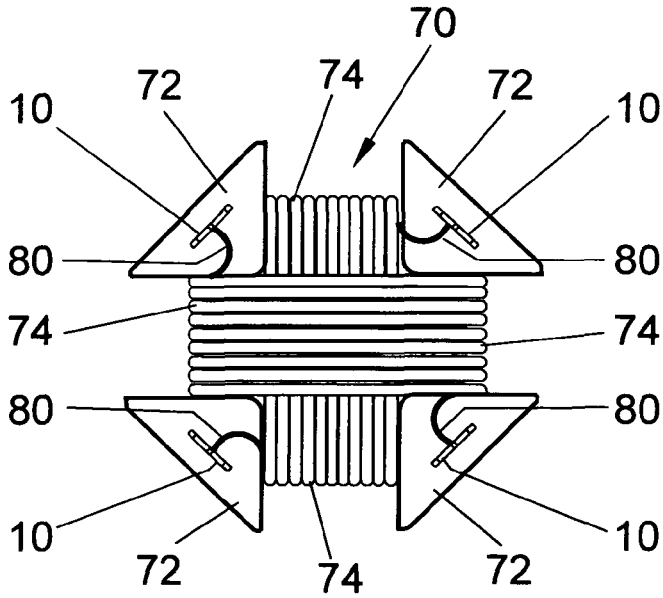
FIG. 5 illustrates a top view of an electronic part with electrical terminal connectors attached to a printed circuit board according to an embodiment of the invention.
Figure 6:
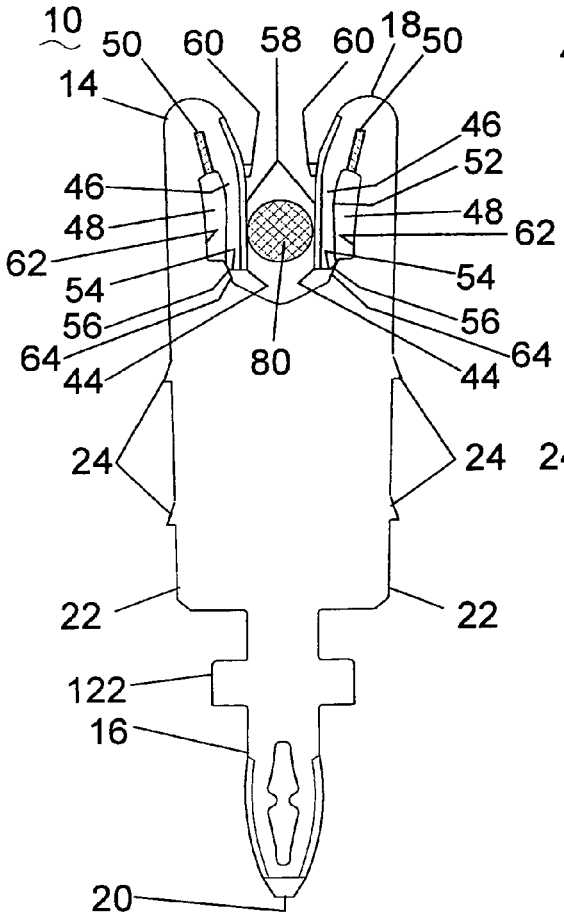
FIG. 6 illustrates a side elevation view of an electrical terminal connector with large gauge wire inserted according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 5, an electrical terminal connector 10 may have a connecting conductor member 12 with an insulator displacement contact 14 at a first end 18 and a press-fit contact 16 at a second end 20. The conductor member 12 may be formed of an electrically conductive generally rigid material with the structure of an elongated flat rectangular bar.

The longitudinal edges 22 may have one or more tabs 24 extending outwardly. The tabs 24 may be formed in the general shape of a triangle with a first surface 26 or edge extending outwardly at an acute angle relative to a longitudinal edge 22 to slope away from the first end 18 of the conductor member 12. A second surface 28 or edge may extend outwardly approximately orthogonal to a longitudinal edge 22 to intersect the first surface 26 to form a vertex 30.

The insulator displacement contact 14 may have opposed contact members 40 with opposed interior edges 42 that may be structured to form a curved "V" open at first end 18 and abutting at a termination end 44. Other structural forms for the opposed interior edges 42 may also be used to allow an insulated or coated wire 80 to be inserted at the open first end 18 to force the wire 80 into the insulator displacement contact 14 to remove the wire 80 insulation for electrical contact with the opposed contact members 40. In the illustrated insulator displacement contact 14 the wire 80 may be forced into truncated end 44 with flexure in opposed contact members 40 having cavity 48 and swaged or scored portions 50.

For an electrical part 70, for example a switch, solenoid, motor or the like with wire coils 74 and elements to be attached to a printed circuit board, the terminal connector 10 can be inserted in the insulated housing 72 to be retained by the engagement of the tabs 24 in the housing 72 material. An electronic part 70 may have one or more apertures 68 in the part's insulator material or housing 72. There may be a first open end 76 of an aperture 68 through which a terminal connector 10 may be inserted at the insulator displacement contact 14 end. The first surfaces 26 of the tabs 24 are slanted to facilitate forcing the terminal connector 10 into the aperture 68 in the material of the part 70 and the second surface 28 then aids in retention of the terminal connector 10 in the material. The insulator displacement contact 14 extends outwardly at the second open end 78 and the press-fit contact 16 extends outwardly at the first open end 76. The wires 80 may be captured by the insulator displacement contact 14, as best viewed in FIGS. 4 and 5.

For use of the terminal connectors 10 with electrical parts such as motors with large gauge wires, for example, for stator magnetic windings, or other electrical parts with large gauge wires, the cavity 48 in the insulator displacement contact 14 may be modified to allow increased flexure of the opposed beams 46. The back edges 52 of each beam 46 at the bottom end 54 of each beam 46 may abut the projecting member 56 formed on the lower side wall 58 of the cavity 48. When the bottom ends 54 are compressed against the projecting members 56 this may cause the material of the abutting surfaces to deform to cause increased compression pressure by the opposed beams 46 against an inserted wire 80. This may result in improved retention of the wire 80 as well as electrical contact.

Figure 7:
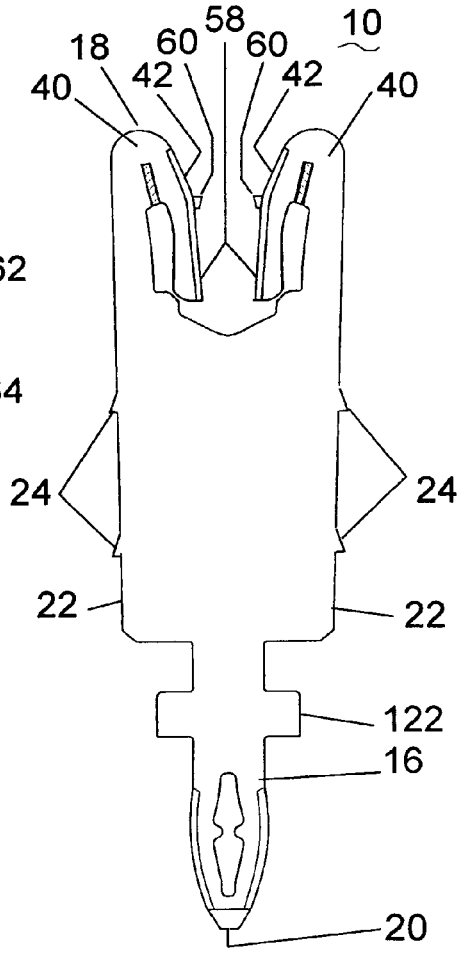
FIG. 7 illustrates a side elevation view of an electrical terminal connector without wire inserted according to an embodiment of the invention.
Figure 8:
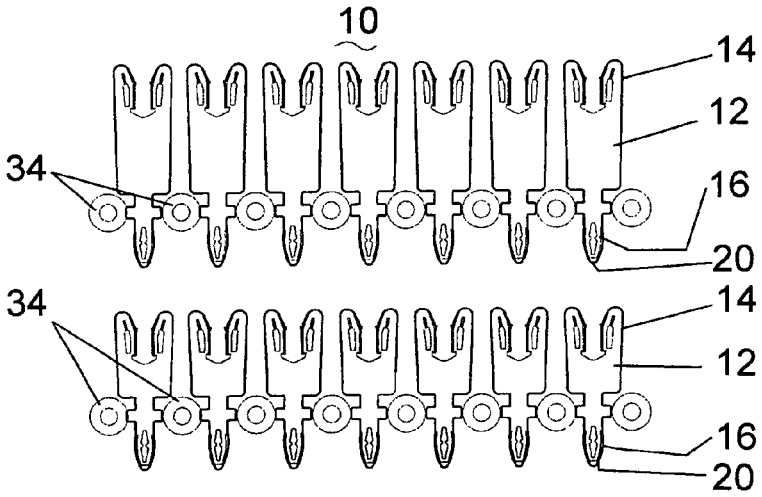
FIG. 8 illustrates a side elevation view of multiple electrical terminal connectors attached and positioned in a continuous row with element carriers according to an embodiment of the invention.

The beams 46 may have a small concave curvature of each interior edge 42 that result in a ridge 58 or high point when a wire 80 is inserted between the beams 46 to a position in the lower portion of the beams 46 adjacent the bottom ends 54. This may aid in retaining a wire 80 in the insulator displacement contact 14 that might otherwise tend to migrate upward under conditions of vibration or due to other conditions. The opposed beams 46 may have slanted interior edges 42 that are slanted from a vertical orientation for each interior edge 42 to incline toward the other from the first end 18 toward the termination end 44 prior to insertion of a wire 80. The incline or slope from vertical may be approximately 4 to 6 degrees. The interior edges 42 may touch at the termination end 44 or may be spaced apart as best viewed in FIG. 7. The opposed interior edges 42 may each have one or more scraping barbs 60 positioned to remove wire 80 insulation material as a wire 80 is pushed into the insulator displacement contact 14.

The press-fit contact 16 may protrude outwardly from the electrical part 70 positioned for direct insertion into a through-hole 92 of a printed circuit board 90 to attach the electrical part 70 to the printed circuit board 90 and for electrical contact with hole circuit 94. The press-fit contact 16 may be a solderless press-fit contact with a relatively strong retention force structure for a terminal connector 10 size of approximately 0.50 mm to 1.5 mm length, and 0.64 mm thickness, see for example U.S. Pat. No. 7,780,483 B1, issued Aug. 24, 2010, regarding press-fit contacts, the contents of which are hereby incorporated by reference.

The press-fit contact portion 16 may have an insert guide portion 132 and a resilient or press fit portion 140. The insert guide portion 132 may be at the insert end 136 or forward end of the contact 16 and may have a beveled tip 138 to aid in inserting the contact 16 in a hole.

The resilient portion 140 may have an opening 142 through the sides 148 that has generally an elliptical shape portion 144 with oblong end portions 146 aligned along the longitudinal axis 112. Two beams 150, 152 or lobes that may be arched may be formed symmetrically along the longitudinal axis 112 and may be spaced apart by opening 142. There may be two opposed, spaced apart projections 154, 156 positioned on the inner surfaces 158 of the opening 142 approximately longitudinally centered along the portion of the longitudinal axis 112 in the opening 142 or positioned along a lateral axis that may intersect an apex or vertex defined as the widest distance point between the outside convex edges 160, 162. The outside edges 160, 162 of the insert guide portion 132 and most of the resilient portion 140 may have a curved surface 164 to allow maximum contact with a through-hole 92 inner electrical contact surface 94. This may also aid in inserting a contact 16 and reduce metal scoring due to right angle edges.

The beam 150, 152 may be formed of electrical conductive material or a base material that is plated to form a resilient arc beam structure. The shape of the beams 150, 152 cause a bulging lobe effect at the outside edges 160, 162 that will be deformed when the resilient portion 140 may be forced into a through-hole 92. The deforming action may cause the beams 150, 152 to move toward the longitudinal axis 112 thereby constricting the opening 142. The movement may or may not cause the projections 154, 156 to touch. The projections 154, 156 should be of sufficiently rigid construction to inhibit further deforming of the beams 150, 152 once the projections 154, 156 touch.

The outside edges 160, 162 of the press-fit contact portion 16 transition from a generally parallel form on the insert guide portion 132 to a convex curve form relative to the longitudinal axis 112 on the resilient portion 140. The resilient portion 140 may transition to a generally parallel form adjacent to the position portion 122. The transitions at 166, 168 of the outside edges 160, 162 between the guide portion 132, the resilient portion 140 and adjacent the position portion 122 may be in the form of arcs of circles to avoid sharp edge steps or angular transition locations that may result in cracks forming adjacent the merging locations 166, 168 of the beams 150, 152 as has been found with prior structures.

The beams 150, 152 merge at first end portions 170, 172 adjacent the transition edges 166 and at the opening insert end 174. The beams 150, 152 merge at second end portions 178, 180 adjacent the transition edges 168 and at the opening contact end 176. The narrower shape of the oblong end portions 146 of the opening 142 may provide additional material strength structure to resist cracking or adverse deformation of the beams as may be caused in existing contact structures. In addition, as discussed above, the projections 154, 156 may prevent excessive deformation of the beams to guard against cracking or adverse deformation. An example of adverse deformation may be the cracking and excessive bending of one beam 150, 152 relative to the second beam such that the contact becomes bent relative to the axis 112 and provides poor electrical contact or retention force in a hole. By setting a proper tolerance for the spacing between opposed projections 154, 156 and the beam material strength, contacts 16 may be forced into tolerance openings, but not forced into out of tolerance holes that may damage the contact 16 that may result in failure in use.

A further feature of the contact 16 may be to shape the beams 150, 152 with a longer insert end portion 182 relative to the contact end portion 184. This may also offset the location of the projections 154, 156 along the longitudinal axis 112 toward the opening contact end 176. The longer insert end portion 182 may allow a longer incline surface on outside edges 160, 162 for forcing the contact 16 into a through-hole 92, but allow the same electrical contact with the hole 92 inner surface.

The electrical terminal connector 10 may allow fewer connection parts such as connector housings, connector assemblies and the like, for assembly of a part on a printed circuit board that can be done without soldering. This may simplify product assembly and result in an over-all reduction in cost. Use of an electrical terminal connector 10 with a press fit contact 16 with strong retention force structure to eliminate soldering should reduce subjection of heat sensitive electronics to the high heat associated with a soldering process.

Multiple terminal connectors 10 may be positioned and attached in a continuous row with element carriers 34. The arrangement of multiple terminal connectors 10 in a line or strip with element carriers 34 used to connect adjacent terminal connector 10 creates a ribbon of parts to facilitate machine manufacturing process insertion of connectors 10 in electronic parts.

While the invention has been particularly shown and described with respect to the illustrated embodiments thereof, it will be understood by those skilled in the art that the foregoing and other changes in form and details may be made therein without departing from the spirit and scope of the invention.

I claim:

1. A terminal connector, comprising:

a connecting conductor member with an insulator displacement contact at a first end and a press-fit contact at a second end;

said connecting conductor member has a plurality of tabs of generally triangular shape extending outwardly from opposed longitudinal edges;

a first surface of each of said tabs extends outwardly at an acute angle relative to said longitudinal edges to slope away from said first end and a second surface of each of said tabs extends outwardly approximately orthogonal to said longitudinal edges to intersect said first surface to form a vertex;

wherein said insulator displacement contact comprising:

two opposed contact members each with an interior edge disposed generally spaced apart and opposed wherein each of said interior edges is formed on two opposed beams each with a first end attached and a termination end unattached;

said interior edges are inclined relative to a longitudinal axis for each of said first ends spaced apart distance to be greater than each of said termination ends spaced apart distance; and a cavity is formed in each of said opposed contact members between a back edge of each of said beams and a side wall interior to each of said contact members.

2. The terminal connector as in claim 1 wherein an insulator scraping barb is formed on each of said opposed interior edges.

3. The terminal connector as in claim 1 wherein a scored portion is formed in each of said opposed contact members disposed adjacent to and above each of said cavities.

4. The terminal connector as in claim 1 wherein each of said opposed beams is formed of a material with a flexure characteristic to bend under the force of an inserted wire to form a ridge in said opposed interior edges when said inserted wire is adjacent said termination ends.

5. The terminal connector as in claim 1 wherein a projecting member is formed on a lower portion of each of said side walls of each of said cavities and each of said projecting members is positioned opposed a bottom end of said back edge of each of said beams; and each of said opposed projecting members is spaced apart from each of said bottom ends a defined distance for a defined wire gauge to be inserted in said insulator displacement contact.

6. The terminal connector as in claim 1 wherein a plurality of said terminal connectors are positioned and attached in a continuous row with adjacent terminal connectors attached at a position portion by an element carrier to form a ribbon of said terminal connectors for application in a machine manufacturing process.

* * * * *